US009405273B2

(12) United States Patent
Nakamura

(10) Patent No.: US 9,405,273 B2
(45) Date of Patent: Aug. 2, 2016

(54) IMAGE FORMING APPARATUS

(71) Applicant: KYOCERA Document Solutions Inc., Osaka (JP)

(72) Inventor: Satoru Nakamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/851,951

(22) Filed: Sep. 11, 2015

(65) Prior Publication Data

US 2016/0085209 A1 Mar. 24, 2016

(30) Foreign Application Priority Data

Sep. 19, 2014 (JP) ..... 2014-191084

(51) Int. Cl.

| | |
|---|---|
| ***G03G 15/00*** | (2006.01) |
| ***G03G 21/20*** | (2006.01) |
| ***B65H 5/22*** | (2006.01) |
| ***B65H 9/00*** | (2006.01) |
| ***B65H 29/58*** | (2006.01) |

(52) U.S. Cl.

CPC ..... *G03G 21/206* (2013.01); *B65H 5/222* (2013.01); *B65H 9/00* (2013.01); *B65H 29/58* (2013.01); *G03G 15/6573* (2013.01); *G03G 21/203* (2013.01)

(58) Field of Classification Search

CPC . G03G 15/2053; G03G 15/20; G03G 15/206; G03G 15/2017; G03G 15/70

See application file for complete search history.

(56) References Cited

U.S. PATENT DOCUMENTS

| | | | | |
|---|---|---|---|---|
| 2006/0051123 | A1* | 3/2006 | Awaya | G03G 21/206 399/92 |
| 2007/0059024 | A1* | 3/2007 | Kitayama | B65H 29/58 399/92 |
| 2010/0329726 | A1* | 12/2010 | Kasuga | G03G 21/206 399/92 |
| 2011/0064449 | A1* | 3/2011 | Shimizu | G03G 15/2017 399/92 |
| 2012/0201564 | A1* | 8/2012 | Masuda | B65H 5/26 399/92 |
| 2013/0078016 | A1* | 3/2013 | Koyama | G03G 15/2003 399/328 |

FOREIGN PATENT DOCUMENTS

| | | |
|---|---|---|
| JP | H07-160179 A | 6/1995 |
| JP | 2011-257500 A | 12/2011 |

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

An image forming apparatus having a sheet conveyance path guiding a sheet to a sheet exit port after the sheet passes through a fixing device. A conveyance unit constitutes one of a pair of sheet conveyance surface portions of the sheet conveyance path. A first cooling fan is disposed within the conveyance unit and sucks air from an air introducing hole in the conveyance unit that is in communication with the sheet conveyance path. A second cooling fan is disposed on an opposite side of the sheet conveyance path to the conveyance unit and blows air at a sheet passing through the sheet conveyance path. A conveyance guide member is fitted to the conveyance unit and switches a conveyance direction of the sheet passing through the sheet conveyance path. The first cooling fan blows at the conveyance guide member air sucked from the air introducing hole.

12 Claims, 9 Drawing Sheets

IMAGE FORMING APPARATUS

INCORPORATION BY REFERENCE

The present application claims priority under 35 U.S.C. §119 to Japanese Patent Application No. 2014-191084, filed on Sep. 19, 2014. The contents of this application are incorporated herein by reference in their entirety.

BACKGROUND

The present disclosure relates to an image forming apparatus including a fixing device.

A fixing device included in an electrographic image forming apparatus generally fixes a toner image to paper by melting the toner through application of heat and pressure to the paper. To do so, the fixing device includes a heat source such as a heater. When a conveyance path and a paper ejection section around the fixing device reach a high temperature due to radiant heat from the fixing device, toner fusing may be adversely affected.

In a situation in which paper is moist, vapor is generated from the paper heated by the fixing device and condenses in the conveyance path located downstream of the fixing device in a paper conveyance direction. As a result, succeeding paper may become wet due to the condensation and may become wrinkled as a result. In duplex printing, toner may not be transferred to a wet part of the paper re-conveyed to a transfer section, resulting in creation of an image void.

In view of the foregoing, a certain image forming apparatus includes a fan above the paper conveyance path that extends from the fixing section to the paper ejection section. Further, a duct is also provided that allows air to flow from the fixing section to the fan via the paper conveyance path and air to flow from a paper exit port to the fan via the paper conveyance path. In the above configuration, water vapor generated in fixing can be removed, thereby preventing paper from being wet by water drops condensed around the paper conveyance path.

Meanwhile, if paper having a high moisture content is heated by the fixing device, vapor may be generated as steam. When the steam is released outside the image forming apparatus, a user may mistake the steam for smoke. In view of the foregoing, a certain image forming apparatus has a configuration in which cool air is blown at a side of paper ejected from the paper ejecting section to cool the obverse and reverse surfaces of the paper. Thus, a situation in which steam is generated from ejected paper can be avoided.

SUMMARY

An image forming apparatus according to the present disclosure includes an image forming section, a fixing device, a sheet conveyance path, a conveyance unit, a first cooling fan, a second cooling fan, and a conveyance guide member. The image forming section is configured to form a toner image on a sheet. The fixing device is disposed downstream of the image forming section in a sheet conveyance direction and configured to apply heat and pressure to the sheet to fix the toner image as unfixed yet to the sheet. The sheet conveyance path has first and second conveyance surface portions and guides the sheet to a sheet exit port after the sheet passes through the fixing device. The conveyance unit constitutes the first sheet conveyance surface portion and has an air introducing hole in communication with the sheet conveyance path. The first cooling fan is disposed within the conveyance unit and configured to suck air through the air introducing hole. The second cooling fan is disposed on an opposite side of the sheet conveyance path to the conveyance unit and configured to blow at the sheet passing air sucked from the sheet conveyance path. The conveyance guide member is fitted to the conveyance unit and configured to switch a conveyance direction of the sheet passing through the sheet conveyance path. The first cooling fan blows at the conveyance guide member air sucked from the air introducing hole.

DETAILED DESCRIPTION

Figure 1:
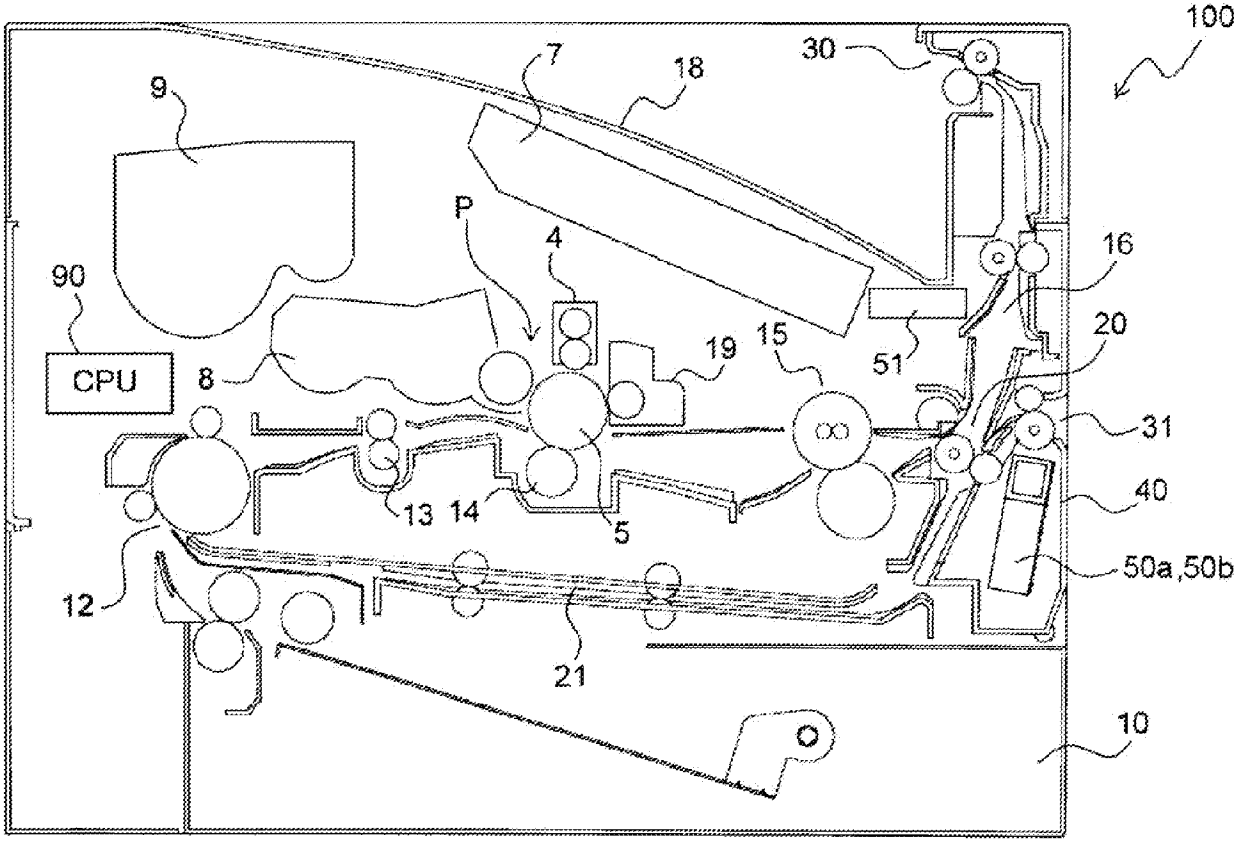
FIG. 1 is a side cross sectional view illustrating an internal configuration of an image forming apparatus according to an embodiment of the present disclosure.
Figure 2:
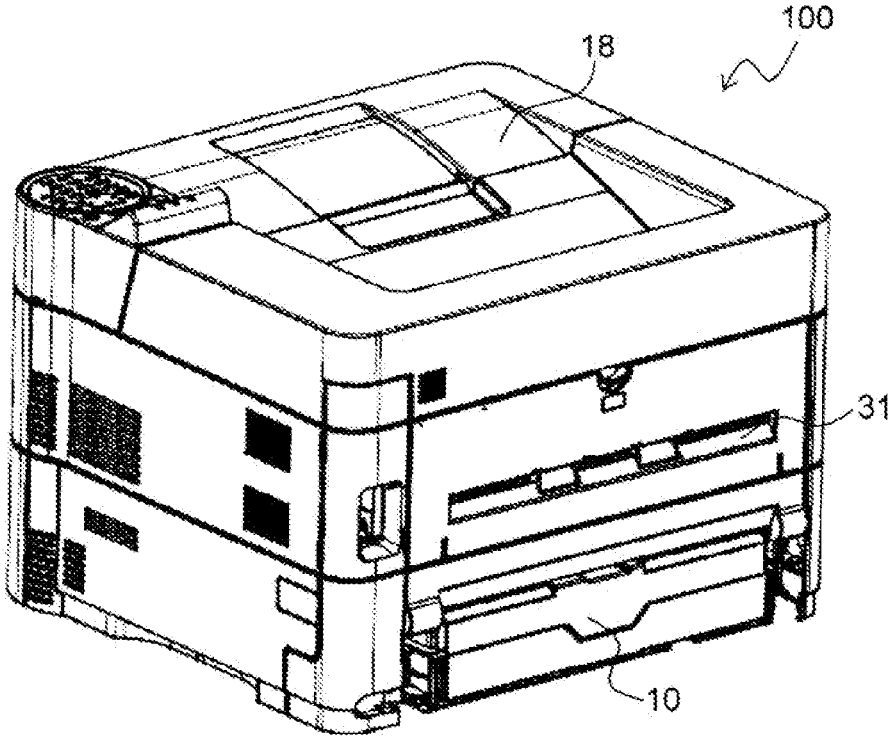
FIG. 2 is an outer perspective view of the image forming apparatus as viewed from the back according to an embodiment of the present disclosure.

An embodiment of the present disclosure will be described with reference to the accompanying drawings.

As illustrated in FIGS. 1-4, an image forming apparatus (e.g., a monochrome printer) 100 includes in the interior thereof, an image forming section P and a fixing device 15. The image forming section P forms a monochrome image through processes including charging, exposure, development, and transfer. A photosensitive drum 5 is disposed in the image forming section P. A charging unit 4, an exposure unit (e.g., a laser scanning unit) 7, a developing unit 8, a transfer roller 14, a cleaning device 19, and a static eliminator (not illustrated) are disposed around the photosensitive drum 5 in a rotation direction (counterclockwise direction in FIG. 1).

In image formation, the charging unit 4 uniformly charges the photosensitive drum 5 as the photosensitive drum 5 rotates counterclockwise. The exposure unit 7 irradiates the photosensitive drum 5 with a laser beam based on image data to form an electrostatic latent image on the photosensitive drum 5. The developing unit 8 attaches toner to the electrostatic latent image to form a toner image. The toner is an example of a developer.

The toner container 9 supplies toner to the developing unit 8. Note that the image data may be transmitted from a personal computer (not illustrated), for example. The static eliminator (not illustrated) for removing residual charge on the surface of the photosensitive drum 5 is located downstream of the cleaning device 19.

Paper (a sheet of paper) is conveyed from a paper feed cassette 10 or a manual paper feeder 11 toward the photosensitive drum 5 on which the toner image is formed via a paper conveyance path 12 and a registration roller pair 13. The transfer roller 14 (an image transfer section) transfers the toner image formed on the surface of the photosensitive drum 5 to the paper. In this manner, the image forming section P forms the toner image on the paper. The paper to which the toner image is transferred is separated from the photosensitive drum 5 and conveyed to the fixing device 15.

The fixing device 15 is located downstream of the image forming section P in a paper conveyance direction (a sheet conveyance direction). The fixing device 15 applies heat and pressure to the paper to fix the toner image as unfixed yet on the paper.

A diverging guide 22 (a conveyance guide member) is disposed at a curved portion 20 of a paper conveyance path 16 (sheet conveyance path). The diverging guide 22 guides the paper to the paper conveyance path 16 once the paper has passed through the fixing device 15. A second paper ejection port 31 in communication with the curved portion 20 is located in a rear surface (a right surface in FIG. 1) of the image forming apparatus 100. The diverging guide 22 determines an ejection destination of the paper to which the toner image is fixed by the fixing device 15 as either a first paper ejection port (a sheet exit port) 30 or the second paper ejection port (a sheet exit port) 31. In short, the diverging guide 22 switches the conveyance direction of the paper passing through the paper conveyance path 16. The diverging guide 22 further guides paper to a reverse conveyance path 21 when the paper is conveyed in the reverse direction through the paper conveyance path 16 during duplex printing.

Once the paper has passed through the fixing device 15 and a conveyance roller pair 23, the paper is conveyed onto the top of the image forming apparatus 100 through the paper conveyance path 16. In image formation on a single side of the paper (simplex printing), the paper is ejected onto an exit tray 18 from the first paper ejection port 30 via a conveyance roller pair 24 and a first ejection roller pair 17*a*. Alternatively, the paper is ejected from the second paper ejection port 31 via a second ejection roller pair 17*b*.

By contrast, in image formation on both sides of the paper (duplex printing), the conveyance roller pair 24 and the first ejection roller pair 17*a* are rotated in the reverse direction to reverse the paper conveyance direction after a tailing edge of the paper passes through the curved portion 20 of the paper conveyance path 16. As a result, the paper is distributed to a reverse conveyance path 21 diverging from the curved portion 20 and re-conveyed to the registration roller pair 13 in a state in which a side of the paper that has received the image is reversed. A toner image formed next on the photosensitive drum 5 is transferred by the transfer roller 14 to a side of the paper on which no image is formed. The paper to which the toner images are transferred is conveyed to the fixing device 15, subjected to fixing of the toner images, and then ejected onto the exit tray 18 from the first paper ejection port 30 via the conveyance roller pair 24 and the first ejection roller pair 17*a*. Alternatively, the paper is ejected from the second paper ejection port 31 via the second ejection roller pair 17*b*. That is, the paper conveyance path 16 guides the paper to the first or second paper ejection port 30 or 31 once the paper has passed through the fixing device 15. Note that the paper is reversed from the first side to the second side in the reverse conveyance path 21 and conveyed to the image forming section P, as described above. The second side of the paper is opposite to the first side thereof.

The image forming apparatus 100 includes a rear cover unit 40 (a conveyance unit). The rear cover unit 40 pivots about a pivot fulcrum 40*a* at the lower end part of the rear cover unit 40 and is openable and closable relative to the main body of the image forming apparatus 100. That is, the rear cover unit 40 is supported in an openable and closable manner on the rear surface of the main body of the image forming apparatus 100. The diverging guide 22, one roller 24*a* of the conveyance roller pair 24, one roller 25*a* of a conveyance roller pair 25, and the second ejection roller pair 17*b* are supported on the rear cover unit 40. The rear cover unit 40 constitutes a paper conveyance surface portion 16*a* (a sheet conveyance surface portion, a first sheet conveyance surface portion) at one side (outer side) of the paper conveyance path 16.

Figure 4:
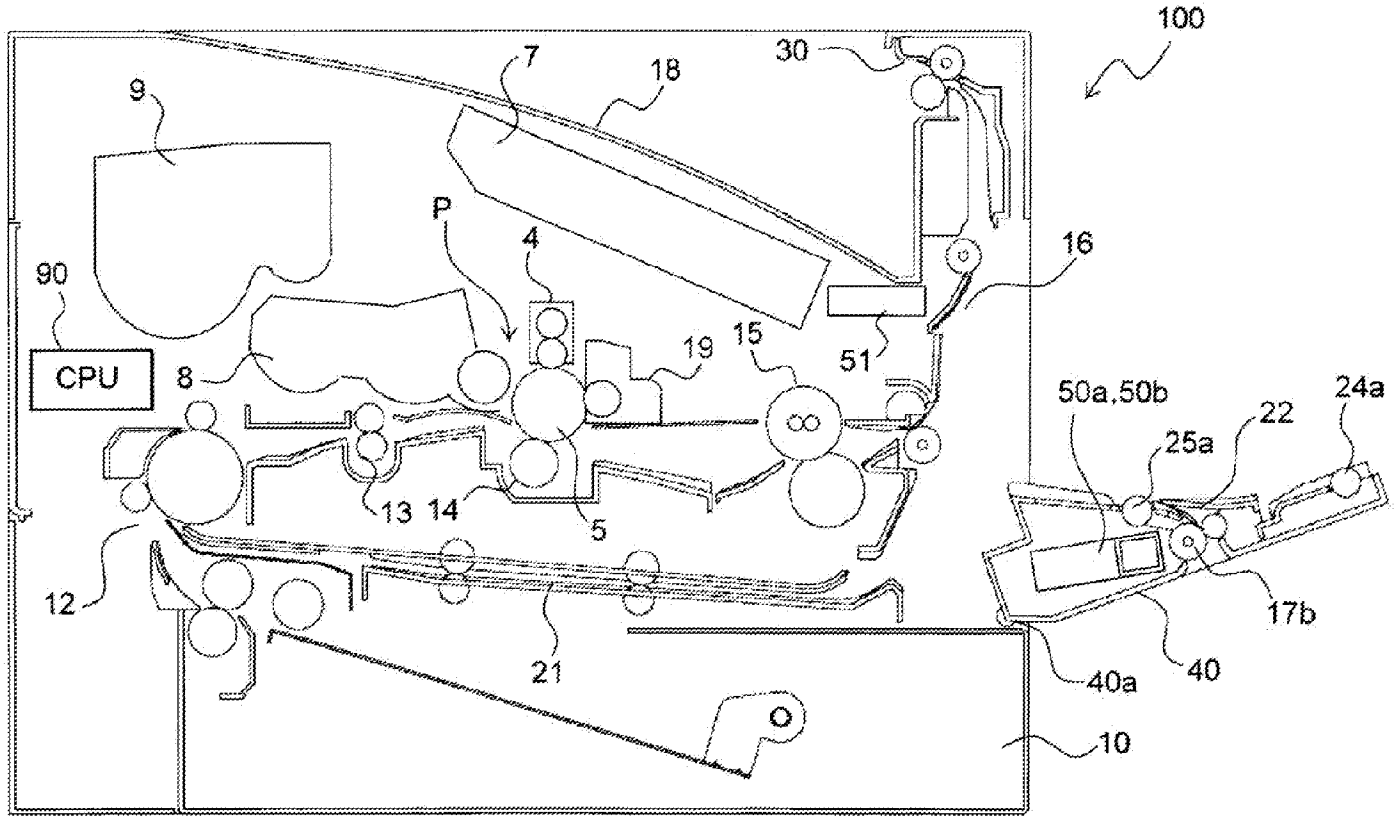
FIG. 4 is a side cross sectional view illustrating a state in which the rear cover unit is open in the image forming apparatus according to an embodiment of the present disclosure.
Figure 5:
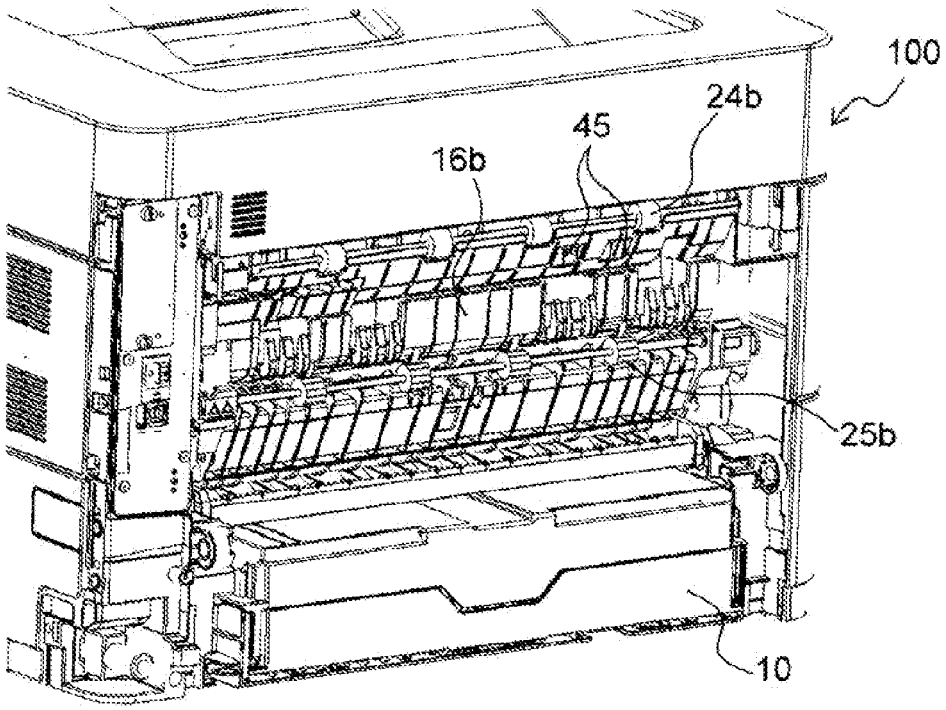
FIG. 5 is an outer perspective view illustrating a state in which the rear cover unit is removed in the image forming apparatus according to an embodiment of the present disclosure.

As illustrated in FIGS. 4 and 5, when the rear cover unit 40 is opened, the paper conveyance path 16 is disassembled. Disassembly of the paper conveyance path 16 can enable removal of a jam (paper jam) in the paper conveyance path 16. Further, first cooling fans 50*a* and 50*b* are disposed within the rear cover unit 40. In addition, a second cooling fan 51 is disposed on the opposite side of the paper conveyance path 16 to the rear cover unit 40.

Moreover, a control section 90 is disposed in the interior of the image forming apparatus 100 to control respective operations of various elements including the image forming section P, the fixing device 15, the first cooling fans 50*a* and 50*b*, and the second cooling fan 51. The control section 90 may include a central processing unit (CPU), for example.

Figure 6:
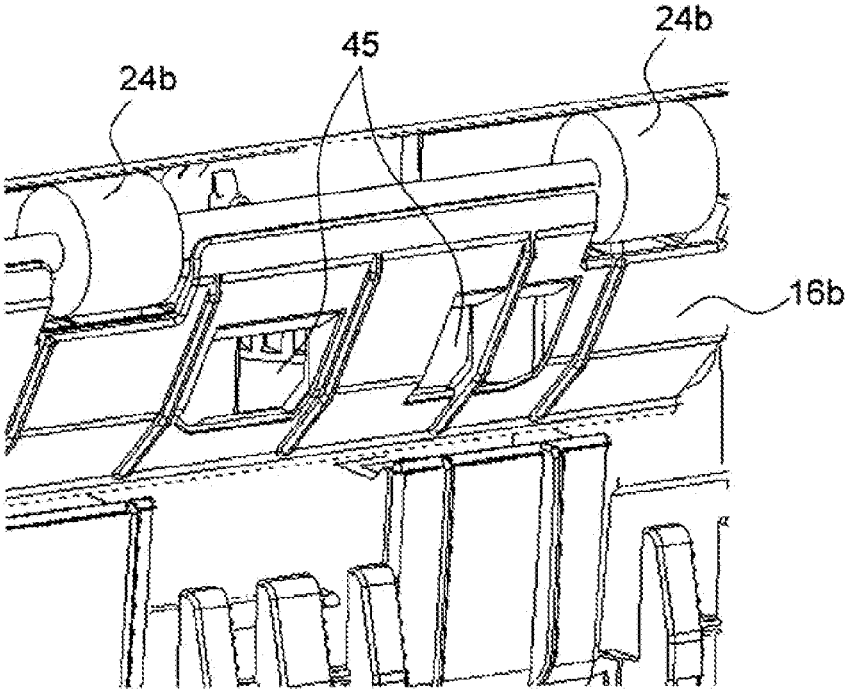
FIG. 6 is a partially enlarged view illustrating a section around an exhaustion port in the image forming apparatus according to an embodiment of the present disclosure.

As illustrated in FIGS. 5 and 6, one roller 24*b* of the conveyance roller pair 24 and one roller 25*b* of the conveyance roller pair 25 are supported on another paper conveyance surface portion (a sheet conveyance surface portion, a second sheet conveyance surface portion) of the paper conveyance path 16. An exhaust port 45 is located in the paper conveyance surface portion 16*b*. The second cooling fan 51 (see FIG. 1) that blows air from the exhaust port 45 is disposed inside the paper conveyance surface portion 16*b*.

Figure 7:
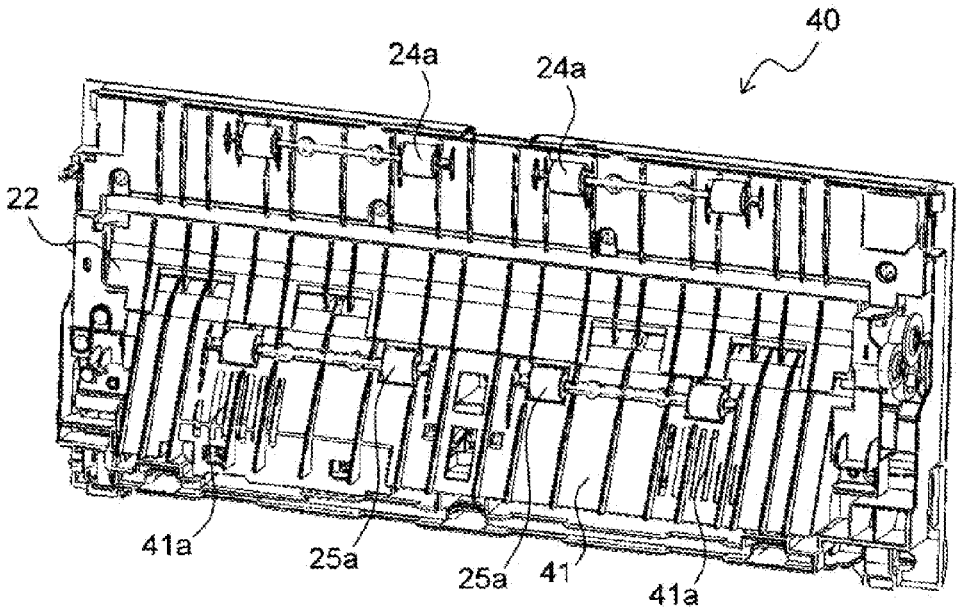
FIG. 7 is a perspective view of the rear cover unit of the image forming apparatus as viewed from inside according to an embodiment of the present disclosure.

As illustrated in FIG. 7, the roller 24*a* of the conveyance roller pair 24 is supported at the upper end part of the paper conveyance surface portion 16*a* constituted by the rear cover unit 40. A conveyance guide 41 is fitted over a central part to a lower end part of the paper conveyance surface portion 16*a*. The diverging guide 22 is swingably supported so as to overlap with an upper end part of the conveyance guide 41.

The roller 25*a* of the conveyance roller pair 25 is supported on the conveyance guide 41. Slit-like air introducing holes 41*a* are located in the conveyance guide 41 at each of two locations in a width direction (right and left directions in FIG. 7) perpendicular to the paper conveyance direction. The air introducing holes 41*a* are in communication with the paper conveyance path 16.

Figure 8:
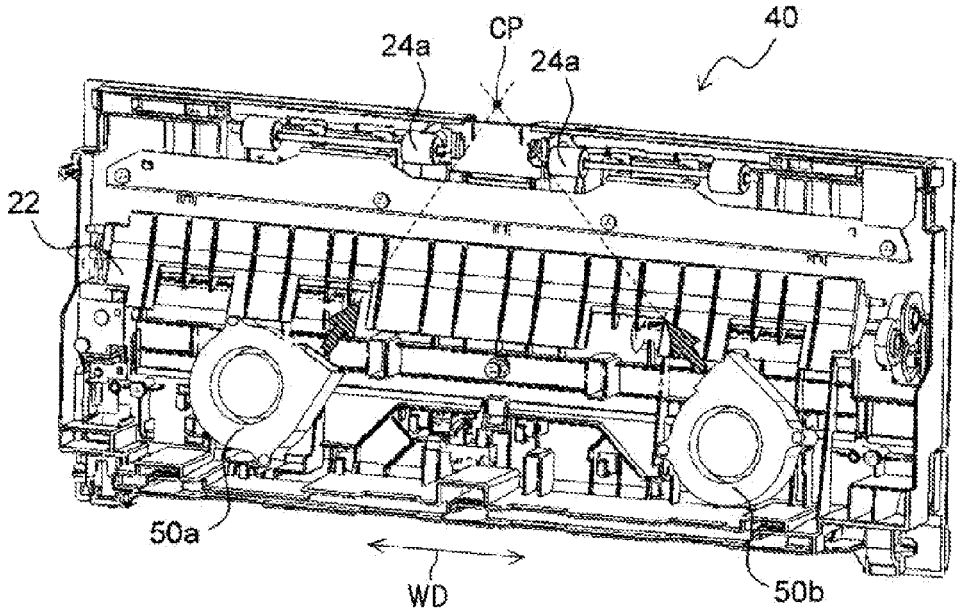
FIG. 8 is a perspective view illustrating a state in which a conveyance guide is removed from the rear cover unit of the image forming apparatus according to an embodiment of the present disclosure.

As illustrated in FIG. 8, the first cooling fans 50*a* and 50*b* are disposed inside the conveyance guide 41 so as to be opposite to the left and right air introducing holes 41*a*, respectively.

Figure 9:
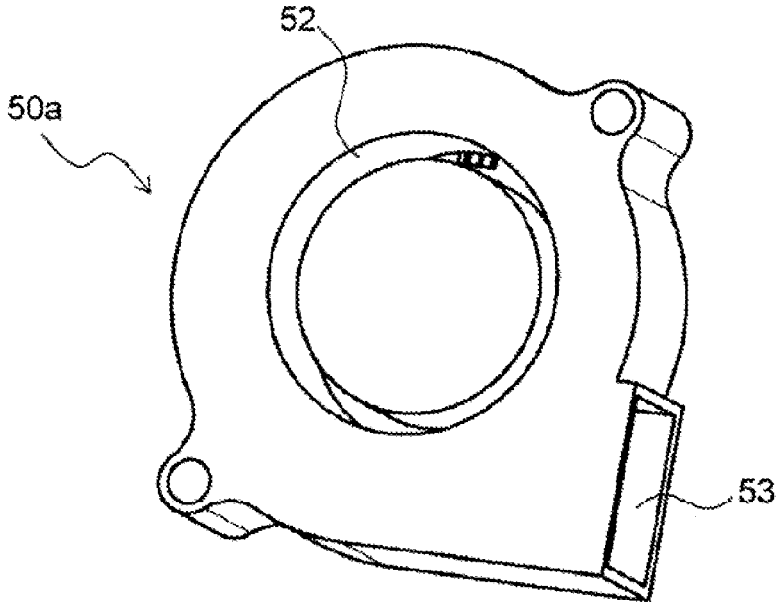
FIG. 9 is a perspective view illustrating a first cooling fan disposed within the rear cover unit of the image forming apparatus according to an embodiment of the present disclosure.

As illustrated in FIG. 9, the first cooling fan 50*a* is a sirocco fan. Specifically, the first cooling fan 50*a* rotates a plurality of blades (not illustrated) extending in a radial direction of the first cooling fan 50*a* to suck air from a sucking port 52 at a central part of the first cooling fan 50*a* and blow the air sucked from a blowing port 53 at an outer circumferential part of the first cooling fan 50*a*.

Figure 3:
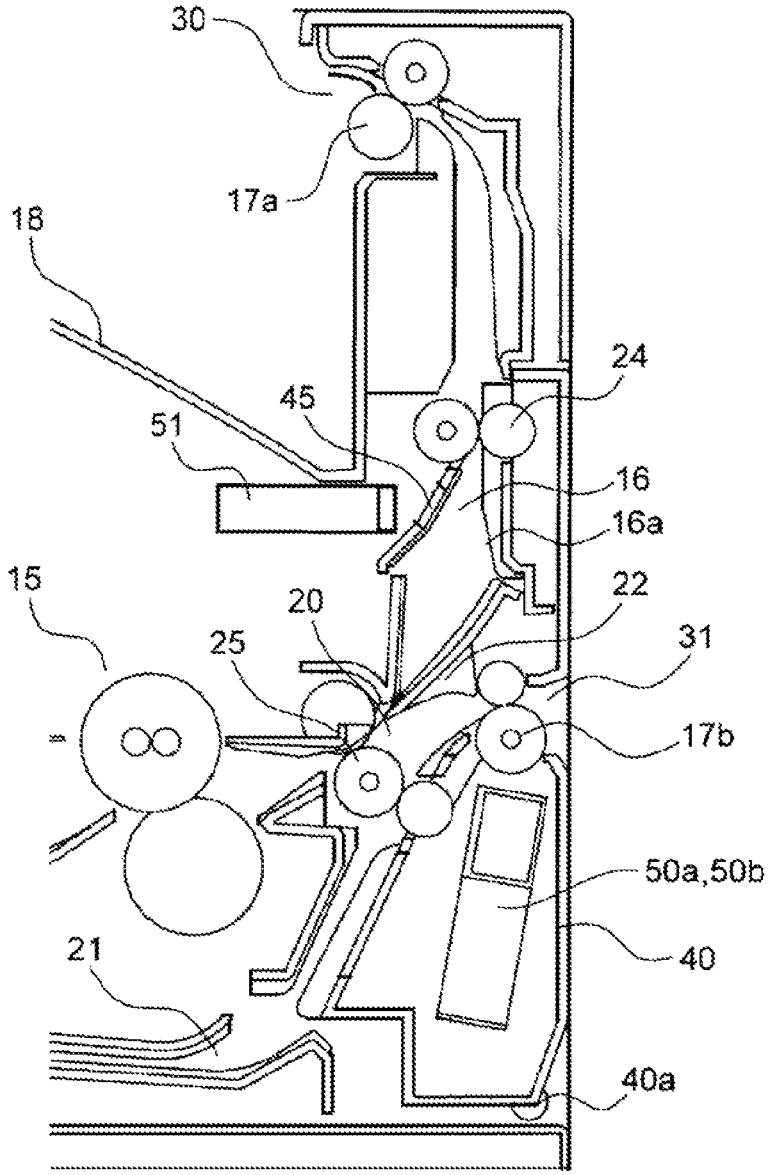
FIG. 3 is a partial cross sectional view illustrating a section around a rear cover unit in the image forming apparatus according to an embodiment of the present disclosure.

The first cooling fan 50*b* is a sirocco fan having the same configuration as the first cooling fan 50*a*. As illustrated in FIGS. 3 and 8, the first cooling fans 50*a* and 50*b* are disposed so as to blow air through the respective blowing ports 53 in a direction in which the paper conveyance path 16 extends. Note that the paper conveyance path 16 extends upward (e.g., vertically upward) from a portion downstream of the fixing device 15 in the paper conveyance direction.

For example, the first cooling fans 50*a* and 50*b* are disposed asymmetrically in the rear cover unit 40 such that the respective blowing ports 53 face obliquely upward (in directions indicated by hatched arrows in FIG. 8). Specifically, the first cooling fans 50*a* and 50*b* are disposed such that air flowing from the blowing port 53 of the first cooling fan 50*a* intersects with air flowing from the blowing port 53 of the first cooling fan 50*b* at a central part CP of the paper conveyance path 16 in a paper width direction WD. In the above configuration, when the blades of the first cooling fans 50*a* and 50*b* rotate, the air sucked from the air introducing holes 41*a* of the conveyance guide 41 is blown toward the reverse surface of the diverging guide 22. That is, the first cooling fans 50*a* and 50*b* blow air sucked through the air introducing holes 41*a* at the diverging guide 22.

Note that the configurations of the first cooling fan 50*b* and the second cooling fan 51 are the same as that of the first cooling fan 50*a* illustrated in FIG. 9. Therefore, description thereof is omitted. The paper width direction WD is perpendicular to the paper conveyance direction.

Figure 10:
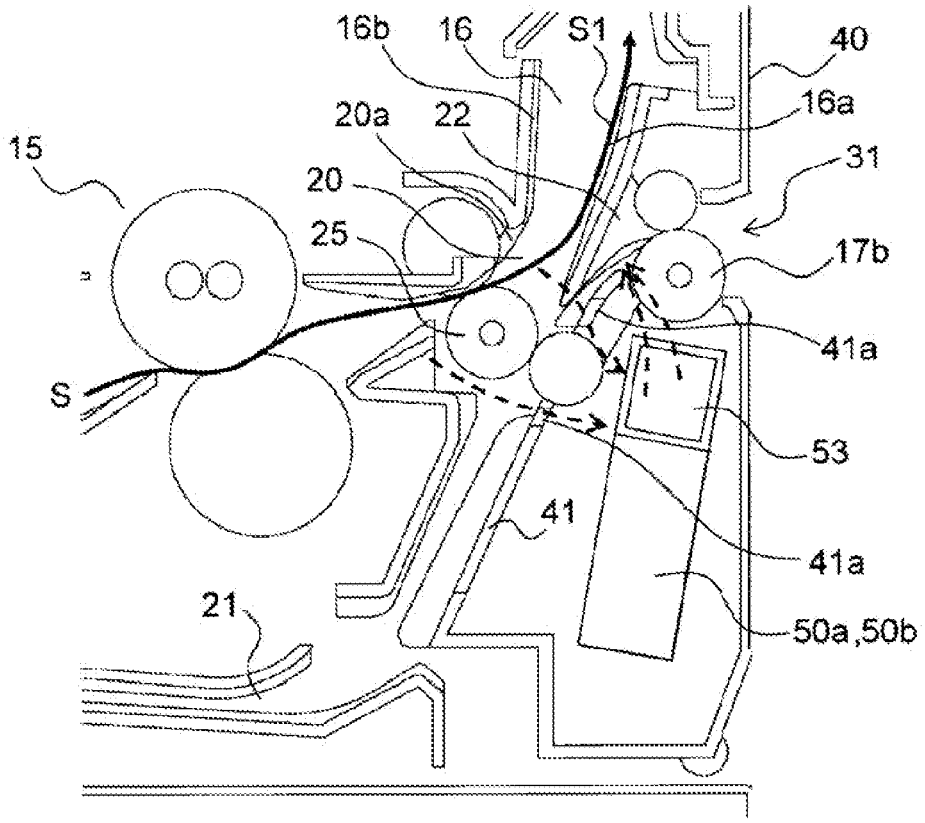
FIG. 10 is a side cross sectional view illustrating a section in the vicinity of the rear cover unit of image forming apparatus during simplex printing according to an embodiment of the present disclosure.

As illustrated in FIG. 10, paper S to which a toner image is fixed in the fixing device 15 is conveyed upward to the paper conveyance path 16 via the curved portion 20. The paper S is heated when passing through a fixing roller pair of the fixing device 15. In a situation in which the paper S is moist, vapor may be accordingly generated from the heated paper S.

In the present embodiment, the first cooling fans 50*a* and 50*b* suck hot air and vapor released from the paper S through the air introducing holes 41*a* in the conveyance guide 41. The heat and vapor are then exhausted toward the reverse surface of the diverging guide 22. On the other hand, the second cooling fan 51 (see FIG. 3) blows air through the exhaust port 45 (see FIG. 6) in the paper conveyance surface portion 16*b* at the paper S passing through the paper conveyance path 16. In the above configuration, vapor released from the paper S is sucked by the first cooling fans 50*a* and 50*b* and dispersed by the second cooling fan 51. As a result, a situation in which the vapor is steamed and a user mistakes the steam for smoke can be avoided.

The first cooling fans 50*a* and 50*b* suck air heated by the paper S and discharge the hot air toward the reverse surface of the diverging guide 22. The diverging guide 22 is accordingly heated. As a result, a situation in which the vapor condenses into water drops on the diverging guide 22 and the paper conveyance path 16 to generate water drops can be avoided.

Moreover, air suction by the first cooling fans 50*a* and 50*b* through the air introducing holes 41*a* of the conveyance guide 41 allows conveyance of the paper S in a state in which the paper S is drawn toward the side of the conveyance guide 41 of the rear cover unit 40 (a side of the paper conveyance surface portion 16*a*). In the above configuration, the paper S can be conveyed stably in a state in which an opposite side (a second side) of the paper S to a print side S1 (a first side) of the paper S is close to the paper conveyance surface portion 16*a*. In other words, the paper conveyance surface portion 16*a* guides the opposite side to the print side S1 of the paper S. The print side S1 is a side of the paper S that is subjected to printing in simplex printing or that is subjected to printing first in duplex printing. The print side S1 of the paper S can be prevented from being abraded on the paper conveyance surface portion 16*b* constituting a part on the inner side (left side in FIG. 10) of the paper conveyance path 16. Accordingly, the print side S1 can be protected. Also, toner can be prevented from being attached to an inner corner surface 20*a* of the curved portion 20 that faces the rear cover unit 40. The inner corner surface 20*a* constitutes the paper conveyance surface portion 16*b* located at an inner corner of the curved portion 20 of the paper conveyance path 16. Note that the air introducing holes 41*a* are located opposite to the inner corner surface 20*a*.

Figure 11:
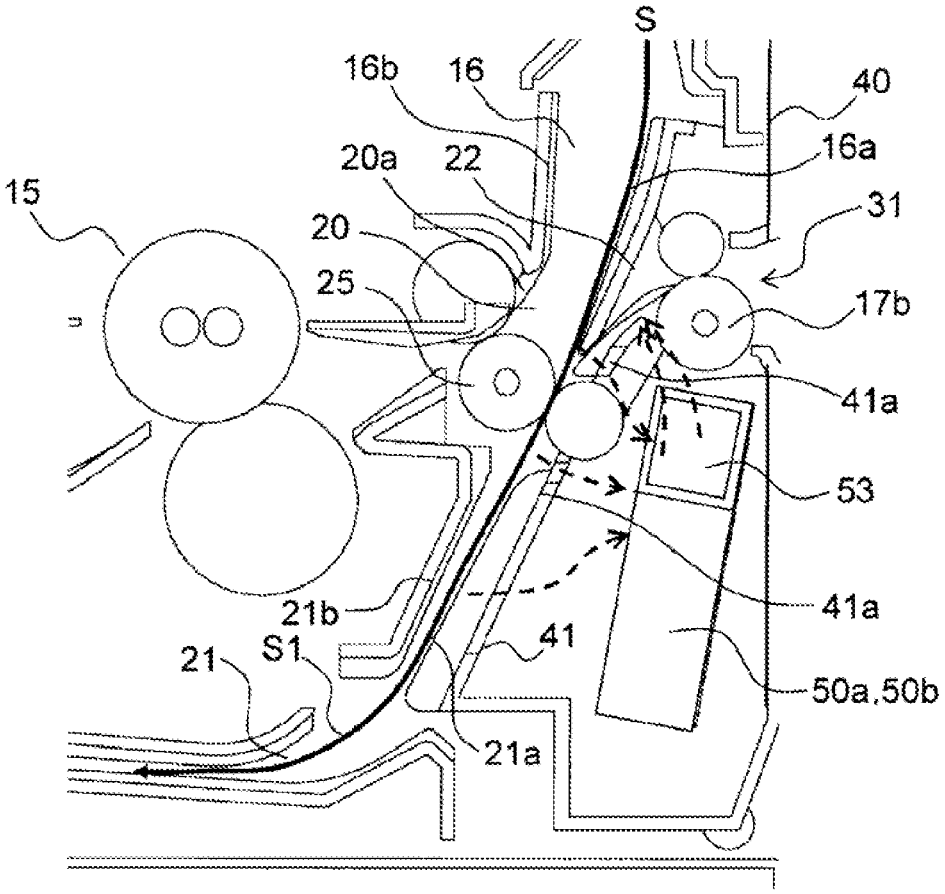
FIG. 11 is a side cross sectional view illustrating a section in the vicinity of the rear cover unit of the image forming apparatus during duplex printing according to an embodiment of the present disclosure.

As illustrated in FIG. 11, the conveyance roller pair 24 and the first ejection roller pair 17*a* are rotated in the reverse direction to reverse the paper conveyance direction after a tailing edge of the paper S passes through the curved portion 20 of the paper conveyance path 16. As a result, the paper S is distributed to a reverse conveyance path 21 diverging from the curved portion 20.

At that time, in the same way as in simplex printing, the first cooling fans 50*a* and 50*b* suck air from the air introducing holes 41*a* in the conveyance guide 41 and the second cooling fan 51 (see FIG. 3) blows exhaust air. In the above configuration, the paper S is conveyed while being drawn toward the conveyance guide 41 (the paper conveyance surface portion 16*a*) of the rear cover unit 40. Accordingly, the paper S can be conveyed stably along the paper conveyance surface portion 16*a* constituting a part on the outer side (right side in FIG. 10) of the reverse conveyance path 21. Further, the print side S1 (the first side) of the paper S can be prevented from being abraded on a reverse surface 21*b* of the reverse conveyance path 21 that constitutes an inner part (a left part in FIG. 10) of the paper conveyance path 16. Thus, the print side S1 can be protected. Also, toner can be prevented from being attached to a reverse surface 21*a* of the reverse conveyance path 21.

Here, in a situation in which the image forming apparatus 100 is used in a low temperature environment, for example, when the first cooling fans 50*a* and 50*b* or the second cooling fan 51 are/is operated in a state in which the inside of the image forming apparatus 100 is warmed insufficiently immediately after power-up or return from an energy saving (sleep) mode of the image forming apparatus 100, cool air is blown into the paper conveyance path 16 and at the diverging guide 22, which may induce condensation.

In view of the foregoing, after power-up or return from the energy saving mode of the image forming apparatus 100, the control section 90 (see FIG. 1) preferably suspends operations of the first cooling fans 50*a* and 50*b* and the second cooling fan 51 until paper that is printed first after the power-up or the return from the energy saving mode of the image forming apparatus 100 is ejected. In other words, the control section 90 preferably suspends the operations of the first cooling fans 50*a* and 50*b* and the second cooling fan 51 until paper printed first after power-up or return from the energy saving mode of the image forming apparatus 100 is ejected after the power-up or the return from the energy saving mode of the image forming apparatus 100. Accordingly, a situation in which the first cooling fans 50*a* and 50*b* and the second cooling fan 51 are operated in a state in which the inside of the image forming apparatus 100 is not sufficiently heated can be avoided. As a result, condensation caused by blowing of cool air at the paper conveyance path 16 and the diverging guide 22 can be prevented. Note that although air suction by the first cooling fans 50*a* and 50*b* and air blowing by the second cooling fan 51 are not performed for paper to be first subjected to printing, the amount of vapor released from a single sheet of paper is not so much to invite user mistake for smoke.

Note that the control section 90 may suspend the operations of at least one of the first cooling fans 50*a* and 50*b* and the second cooling fan 51 until paper printed first after power-up or return from the energy saving mode of the image forming apparatus 100 is ejected after the power-up or the return from the energy saving mode of the image forming apparatus 100.

As has been described so far, in the image forming apparatus 100 according to the present embodiment, condensation of vapor generated from paper around the fixing device 15 through fixing and release of the vapor outside the image forming apparatus 100 can be reduced effectively.

The present disclosure is not limited to the above embodiment. Various alterations can be made without departing from the gist of the present disclosure. For example, the first cooling fans 50*a* and 50*b* and the second cooling fan 51 are sirocco fans in the above embodiment. However, a propeller fan that sucks air in the rear cover unit 40 may be used instead of any of the sirocco fans. The same advantages as in the above embodiment can be obtained in this configuration. The respective locations and the respective numbers of first cooling fans 50*a* and 50*b* and second cooling fans 51 are not limited as above. Two or more second cooling fans 51 may be provided. One or three or more first cooling fans (the first cooling fans 50*a* and 50*b*) may be provided.

What is claimed is:

1. An image forming apparatus comprising:

an image forming section configured to form a toner image on a sheet;

a fixing device disposed downstream of the image forming section in a sheet conveyance direction and configured to apply heat and pressure to the sheet to fix the toner image as unfixed yet to the sheet;

a sheet conveyance path that has a first sheet conveyance surface portion and a second sheet conveyance surface portion and that guides the sheet to a sheet exit port after the sheet passes through the fixing device;

a conveyance unit constituting the first sheet conveyance surface portion and having an air introducing hole in communication with the sheet conveyance path;

a first cooling fan disposed within the conveyance unit and configured to suck air within the sheet conveyance path through the air introducing hole;

a second cooling fan having a sucking port and a blowing port and configured to blow air at the sheet passing through the sheet conveyance path; and a conveyance guide member fitted to the conveyance unit and configured to switch a conveyance direction of the sheet passing through the sheet conveyance path, wherein an exhaust port is located in the second sheet conveyance surface portion, the second cooling fan is disposed opposite to a reverse surface of the second sheet conveyance surface portion, sucks air inside a main body of the image forming apparatus through the sucking port, and blows out the sucked air from the blowing port to blow air flow toward the sheet conveyance path through the exhaust port, and the first cooling fan blows at a reverse surface of the conveyance guide member the air sucked from the air introducing hole from below the conveyance guide member.

2. The image forming apparatus according to claim 1, further comprising:

a reverse conveyance path that diverges from a curved portion of the sheet conveyance path and through which the sheet is conveyed to the image forming section in a state in which a first side and a second side of the sheet are reversed, wherein the conveyance guide member guides the sheet to the sheet conveyance path after the sheet passes through the fixing device and guides the sheet to the reverse conveyance path when the sheet is conveyed in a reverse direction through the sheet conveyance path during duplex printing.

3. The image forming apparatus according to claim 1, further comprising:

a control section configured to control operation of the first cooling fan and the second cooling fan, wherein the control section suspends the operation of the first cooling fan and/or the second cooling fan until a sheet is ejected from the sheet exit port after power-up or return from an energy saving mode of the image forming apparatus, the sheet being printed first after the power-up or the return from the energy saving mode of the image forming apparatus.

4. The image forming apparatus according to claim 1, wherein the conveyance unit is supported on a side surface of a main body of the image forming apparatus in an openable and closable manner, and the first sheet conveyance surface portion guides a second side of a sheet that is an opposite side to a first side subjected to printing in simplex printing or subjected to printing first in duplex printing.

5. The image forming apparatus according to claim 1, wherein the air introducing hole is located opposite to a conveyance surface portion that is located on an inner corner of a curved portion of the sheet conveyance path.

6. The image forming apparatus according to claim 1, wherein the first cooling fan and the second cooling fan each are a sirocco fan having a suction port, a blowing port located in an outer circumferential part of the sirocco fan, and a plurality of blades extending in a radial direction of the sirocco fan, and the sirocco fan rotates the blades to suck air from the suction port and blow sucked air from the blowing port.

7. The image forming apparatus according to claim 1, wherein the first cooling fan includes two first cooling fans, the two first cooling fans each have a blowing port, and the two first cooling fans are disposed asymmetrically in the conveyance unit such that the respective blowing ports face obliquely upward.

8. The image forming apparatus according to claim 7, wherein the two first cooling fans are disposed such that air flowing from the blowing port of one of the two first cooling fans intersects with air flowing from the blowing port of the other one of the two first cooling fans at a central part of the sheet conveyance path in a sheet width direction.

9. The image forming apparatus according to claim 7, wherein the sheet conveyance path extends upward from a location downstream of the fixing device in the sheet conveyance direction, and the two first cooling fans are disposed so as to blow air through the respective blowing ports in a direction in which the sheet conveyance path extends.

10. The image forming apparatus according to claim 1, further comprising:

a reverse conveyance path that diverges from a curved portion of the sheet conveyance path and through which the sheet is conveyed to the image forming section in a state in which a first side and a second side of the sheet are reversed, wherein the conveyance guide member guides the sheet to the sheet conveyance path after the sheet passes through the fixing device and guides the sheet to the reverse conveyance path when the sheet is conveyed in a reverse direction through the sheet conveyance path during duplex printing, the first cooling fan includes two first cooling fans, the first cooling fans and the second cooling fan each are a sirocco fan having a suction port, a blowing port located in an outer circumferential part of the sirocco fan, and a plurality of blades extending in a radial direction of the sirocco fan, the sirocco fan rotates the blades to suck air from the suction port and blow sucked air from the blowing port, the two first cooling fans are disposed asymmetrically in the conveyance unit such that the respective blowing ports face obliquely upward, the two first cooling fans are disposed such that air flowing from the blowing port of one of the two first cooling fans intersects with air flowing from the blowing port of the other one of the two first cooling fans at a central part of the sheet conveyance path in a sheet width direction, the air introducing hole includes a plurality of air introducing holes, a part of the air introducing holes are located opposite to the one of the two first cooling fans, the other of the air introducing holes are located opposite to the other one of the two first cooling fans, the image forming apparatus further comprises:

a plurality of first conveyance roller pairs each including two first rollers; and a plurality of second conveyance roller pairs each including two second rollers, one of the two first rollers is supported by the conveyance unit and located above the conveyance guide member, one of the two second rollers is supported by the conveyance unit and located below the conveyance guide member while being located above the air introducing holes, the first cooling fans are located below the one of the two first rollers and sucks the air within the sheet conveyance path through the air introducing holes and an opening in which the one of the second rollers is disposed, the other of the two first rollers is supported on the second sheet conveyance surface, and the other of the two second rollers is supported on the second sheet conveyance surface.

11. The image forming apparatus according to claim 10, wherein the conveyance unit includes a conveyance guide fitted over the first sheet conveyance surface, the conveyance guide covers the two first cooling fans, the plurality of air introducing holes are located in the conveyance guide, the one of the second rollers is supported by the conveyance guide, and the conveyance guide member is swingably supported by the conveyance unit so as to overlap with an upper end part of the conveyance guide.

12. The image forming apparatus according to claim 1, wherein the first cooling fan sucks heat and vapor released from the sheet through the air introducing hole and exhausts the heat and the vapor toward the reverse surface of the conveyance guide member, and the second cooling fan blows exhaust air to the sheet through the exhaust port to disperse vapor released from the sheet.

* * * * *